United States Patent [19]

Dziedzic

[11] Patent Number: 4,467,575

[45] Date of Patent: Aug. 28, 1984

[54] INTERNALLY DRIVEN EARTH ANCHOR HAVING SMALL DIAMETER ANCHOR ROD

[75] Inventor: Edward Dziedzic, Centralia, Mo.

[73] Assignee: A. B. Chance Company, Centralia, Mo.

[21] Appl. No.: 502,587

[22] Filed: Jun. 9, 1983

[51] Int. Cl.[3] ..... E02D 5/80

[52] U.S. Cl. ..... 52/157; 405/258

[58] Field of Search ..... 405/259–262; 52/157–167

[56] References Cited

U.S. PATENT DOCUMENTS

| | | | |
|---|---|---|---|
| 2,234,907 | 3/1941 | Williams | 52/157 |
| 3,318,058 | 5/1967 | Sullivan | 52/157 |
| 3,377,077 | 4/1968 | Hollander et al. | 52/157 |
| 3,832,860 | 9/1974 | Jahnke | 52/157 X |
| 4,334,392 | 6/1982 | Dziedzic | 405/259 X |

*Primary Examiner*—Dennis L. Taylor

*Attorney, Agent, or Firm*—Schmidt, Johnson, Hovey & Williams

[57] ABSTRACT

An improved modular screw anchor is provided which is adaptable for use with many sizes of elongated anchor rods, is inexpensive to manufacture, can be installed in a wide variety of soil conditions including rocky soils, and permits use of a number of wrench tubes having different internal dimensions. The anchor preferably includes two main components, namely an elongated anchor rod having an obliquely oriented, beveled earth-penetrating lead at one end, and a polygonal in cross-section drive boss separated from the lead by an enlarged, annular flange, and, secondly, an anchor member having a bore-defining hub, an outwardly extending, helical blade circumferentially secured to the hub, and an apertured plate affixed across the bore of the hub. The anchor rod and anchor member are interfitted for installation by inserting the rod through the apertured plate of the hub until the drive boss extends through the aperture and the flange abuts the apertured plate. A polygonal in cross-section tubular anchor wrench is then telescoped over the rod and inserted into the hub bore; the wrench tube is complementally configured for establishing a driving engagement between the outer faces of the wrench and the hub, and between the inner faces of the wrench and the drive boss. Axial rotation of the wrench thus effects rotation of the anchor for installation. The engagement of the flange to the apertured plate is particularly advantageous because this arrangement allows the lead, flange, and drive boss to be dimensioned for use with a smaller diameter rod.

7 Claims, 11 Drawing Figures

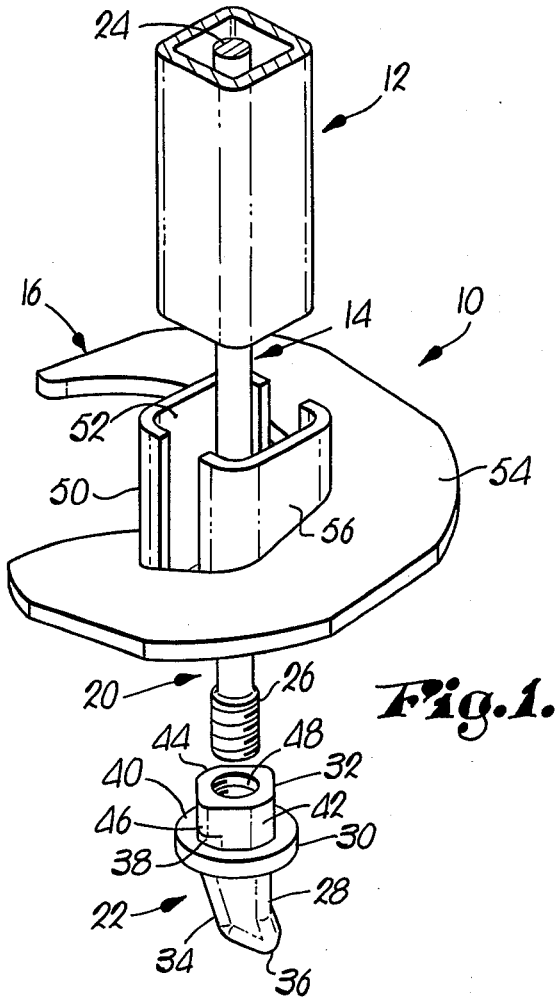
Fig.1.
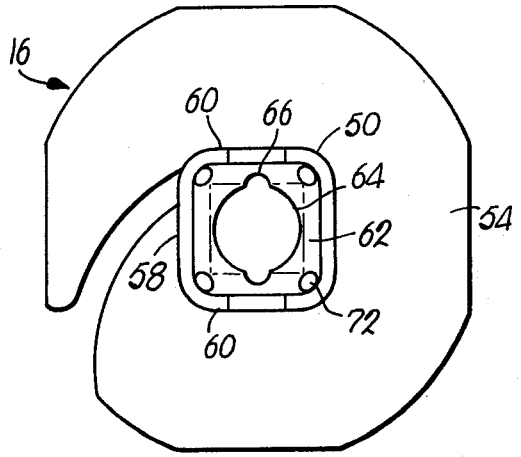
Fig.3.
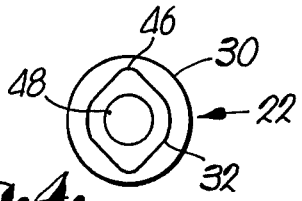
Fig.4.
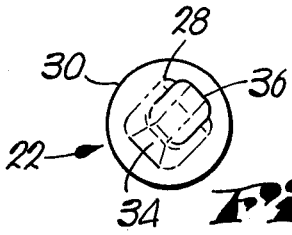
Fig.5.
Fig.2.
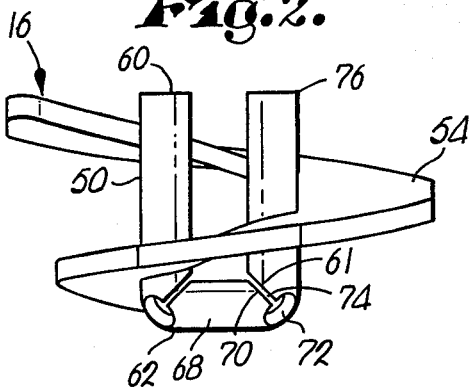
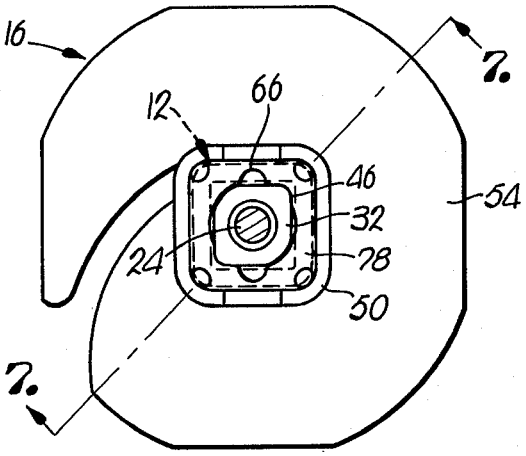
Fig.6.

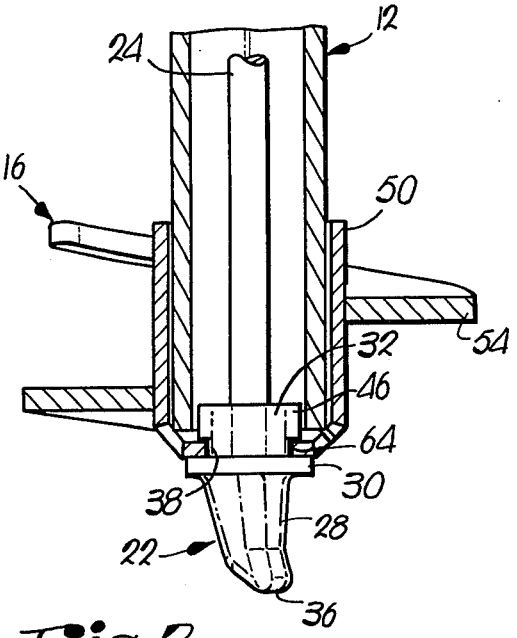
Fig. 7.
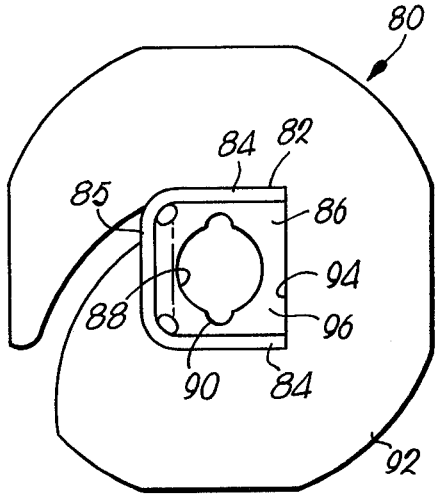
Fig. 8.
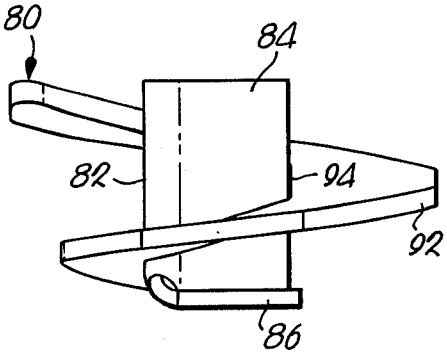
Fig. 9.
Fig. 11.
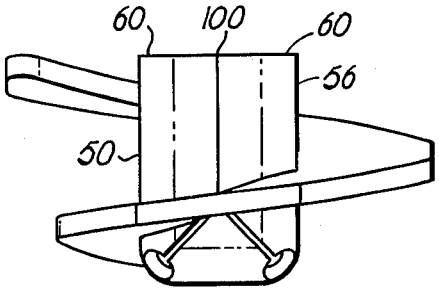
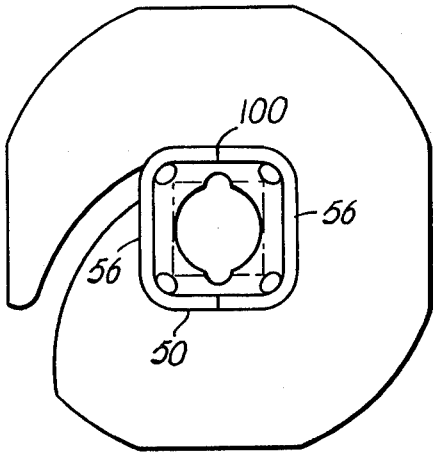
Fig. 10.

INTERNALLY DRIVEN EARTH ANCHOR HAVING SMALL DIAMETER ANCHOR ROD

BACKGROUND OF THE INVENTION

1. Field of the Invention

This invention relates to an improved modular screw anchor which is easily installed even under the most difficult of soil conditions and which is designed to considerably reduce manufacturing and inventory costs. More particularly, it is concerned with a two component anchor having an elongated rod component and an anchor member. The elongated rod incorporates an earth penetrating lead at one end, an annular, outwardly extending flange adjacent the lead, and a drive boss adjacent the flange. The anchor member includes an elongated bore-defining hub, an outwardly extending load-bearing element secured to the hub and an apertured plate secured transversely to the hub bore. When the anchor member component and the rod component are assembled in accordance with the present invention, the resulting earth anchor can be installed using conventional screw anchor wrenches and, advantageously, the wrench drivingly engages each component separately.

2. Description of the Prior Art

Power installed earth screw anchors have gained widespread use in a variety of applications. Dominating the power installed earth screw anchor market is an anchor comprising an elongated, square in cross-section shaft having a beveled, earth-penetrating end, and one or more helical blades affixed to the square shaft. For installing such an anchor, a conventional, square in cross-section, tubular anchor wrench is drivingly engaged to the anchor by inserting the square shaft into the wrench tube. The wrench tube is typically operably coupled to power installation equipment, whereby axial rotation of the wrench tube in turn axially rotates the screw anchor, and effects installation of the anchor into the earth. While this anchor and installation method are effective in normal soils, problems have been encountered in installing this type of anchor in many types of soils, such as glacial till, broken rock, gravel, sandstone, limestone, shale, and clay. While modern installation equipment can develop sufficient torque to install the anchor, such an anchor when encountering the difficult soil has a tendency to break apart, either by breaking the anchor shaft or stripping the helical blades from the shaft.

A modular screw anchor has been recently developed which overcomes the torsional breakage problem typical with the conventional screw anchor. An example of this revolutionary modular screw anchor is illustrated on page 2 of the May 1982 issue of *Chance Tips* published by A. B. Chance Company, Centralia, Mo. Such a modular anchor incorporates a helical screw blade secured to a unitary, open-ended, square in cross-section, tubular hub. The anchor also includes an elongated, unitary, forged rod assembly which includes a beveled lead point at one end, an enlarged circular flange adjacent the lead, and a square in cross-section wrench-engaging portion adjacent the flange. The rod assembly is inserted through the tubular hub until the rod flange contacts the hub walls. A conventional tubular screw anchor wrench is then telescoped over the anchor rod such that the outer faces of the wrench drivingly engage the inner walls of the tubular hub, and the inner faces of the wrench drivingly engage the square, wrench-engaging portion of the rod.

This revolutionary modular screw wrench has yielded spectacular results in overcoming many of the torsional breakage problems associated with previous screw anchors. However, the manufacture of this modular screw anchor has proven expensive for several reasons. First, the forging technology for making the wrench engaging section, flange and lead is such that, for practical purposes, only elongated rods of larger diameters can be used. Smaller diameter rods have insufficient material for forging of these components. However, for many applications at the critical regions of the rod, the tensile strength of such a large diameter rod is simply not necessary and thus use of these large rods constitutes a serious and expensive waste of materials. Additionally, it has been discovered to be expensive to manufacture the square, tubular hub because of the bending, holding jigs, and tack welding steps involved. Thus, while the newly developed modular screw anchor is very effective in anchor applications, it can be expensive to manufacture and use, particularly in anchoring applications where relatively small diameter rods are sufficient.

SUMMARY OF THE INVENTION

The problems outlined above are in large measure solved by the improved modular screw anchor in accordance with the present invention. That is, the screw anchor hereof is designed for use with elongated rods having various diameters, but is particularly advantageous for use with rods having smaller diameters. Additionally, the screw anchor of the present invention is inexpensively manufactured, and its design allows for interchangeability of parts, resulting in significant inventory cost savings. Particularly important is the anchor's ability to be installed in many types of rocky soils without breakage or structural failure of the anchor.

The earth anchor in accordance with the present invention broadly includes two major components, an elongated rod and an anchor member. The elongated rod includes an earth-penetrating lead adjacent one end, an annular, outwardly extending flange adjacent the lead, and a drive boss, which is polygonal in cross-section for a portion thereof, adjacent the flange. The anchor member comprises an elongated, bore-defining hub, an outwardly extending load-bearing element secured to the hub, and an apertured plate secured to the hub and disposed transverse to the longitudinal axis of the hub. The plate aperture is dimensioned and arranged for clearance of the drive boss of the elongated rod when the rod is inserted through the aperture into the hub bore. With the rod extending into the hub bore, the flange is adjacent one end of the hub and the boss extends through the plate aperture such that portions of the hub bore surround the drive boss in a spaced relationship; the boss and hub bore portions thereby cooperatively define a wrench-receiving area. The cross sectional dimensions of the hub bore portions and the drive boss are correlated such that the wrench-receiving area is sufficient for passage of a complemental wrench tube between the hub bore portions and the boss, thereby establishing a driving engagement between the tube, boss and hub. Axial rotation of the wrench tube transits axial rotation to the anchor effecting installation of the same.

In particularly preferred forms, the bore-defining hub comprises a pair of opposed, spaced apart, U-shaped in cross-section elements. The apertured plate interconnects the U-shaped elements at one end while the helical screw blade is affixed to the elements in a spiral fashion to complete the structural integrity of the anchor member. In the preferred form, the plate aperture includes a centrally located circular portion having a pair of opposed, arcuate notches extending outwardly from the perimeter of the cutout. Such an aperture allows for use of a drive boss presenting an upper enlarged drive section, which in turn allows use of wrench tubes having different sized internal dimensions.

DESCRIPTION OF THE DRAWING

FIG. 1 is a fragmentary, somewhat exploded view illustrating the components of the screw anchor in accordance with the present invention;

FIG. 2 is a side elevational view of the anchor member of the preferred embodiment;

FIG. 3 is a plan view of the anchor member;

FIG. 4 is a plan view of the elongated rod of the present invention, depicting the rhomboidal shape of a portion of the preferred drive boss;

FIG. 5 is a bottom view of the elongated rod, illustrating the oblique orientation of the beveled lead;

FIG. 6 is a plan view of the device illustrated in FIG. 1;

FIG. 7 is a vertical sectional view taken along line 7—7 of FIG. 6;

FIG. 8 is a plan view of a second embodiment of the present invention;

FIG. 9 is a side elevational view of the device illustrated in FIG. 8;

FIG. 10 is a plan view of a third embodiment in accordance with the present invention; and FIG. 11 is a side elevational view of the device depicted in FIG. 10.

DESCRIPTION OF THE PREFERRED EMBODIMENT

Referring now to the drawings, particularly FIGS. 1–7, the preferred embodiment of the modular screw anchor 10 in accordance with the present invention is illustrated, with FIGS. 1, 6, and 7 additionally depicting a conventional, square in cross-section, tubular screw anchor wrench 12 used to install the anchor 10. The installation wrench 12 is of the type described in U.S. Pat. No. 3,377,077 (the latter patent being incorporated by reference herein). Broadly speaking, the anchor 10 includes two modular components, an elongated rod 14 and an anchor member 16.

In more detail, as illustrated in FIG. 1, the elongated rod 14 is the assemblage of an extension section 20 and a penetrator or lead portion 22. The main component of the extension section 20 is an elongated, rectilinear, cylindrical in cross-section, shaft 24, the length and diameter of shaft 24 varied according to the particular application of anchor 10. One end of shaft 24 includes a threaded portion 26, integral with shaft 24, formed by cold rolling for greater strength, with the result that the outside diameter of threaded portion 26 is slightly greater than the outside diameter of shaft 24.

The portion 22 of elongated rod 14 includes a lower earth-penetrating lead 28, an annular, outwardly extending flange 30 adjacent the lead 28, and a drive boss 32 adjacent the flange 30. As seen in FIGS. 1 and 5, the lead 28 is in the form of an elongated, generally square in cross-section element 34 depending from flange 30 which is obliquely oriented relative to the longitudinal axis of extension section 20. The oblique orientation of section 34 is further accentuated by the lowermost beveled tip 36. The drive boss 32 includes a generally square in cross-section upstanding neck 38, coaxial with and adjacent the upper engagement face 40 of flange 30. As seen in FIG. 1, neck 38 has slightly rounded corners as at 42. Immediately adjacent the neck 38 is the generally rhomboidal in cross-section drive portion 44. Portion 44 is generally conterminus with the neck 38, with the exception of a pair of opposed, outwardly extending ears 46 located at the opposite ends of the major axis of the rhomboidal drive portion 44. Finally, the drive boss 32 includes an axial bore 48 therein which is complementally threaded to receive the threaded portion 26 of extension section 20.

The anchor member 16 presents an elongated, tubular hub 50 whose structure defines a generally square in cross-section bore 52 therethrough. An outwardly extending, load-bearing helical blade 54 is affixed (as by welding) to portions of the exterior of hub 50. The hub 50 of the preferred embodiment comprises a pair of opposed, U-shaped in cross-section portions 56, each portion 56 presenting an elongated, flattened primary wall 58 with a relatively short, flattened, generally rectangular shaped, secondary wall 60 secured at each distal end of the primary wall 58 approximately perpendicular thereto. The secondary walls 60 are oriented in the same direction, thereby completing the U-shaped configuration of portion 56, and include angled terminal edges 61 at one end thereof. The hub 50, while open at one end, has an apertured plate 62 secured to the opposite end thereof, the plate being oriented transverse to the longitudinal axis of the hub 50. The plate 62 is integral with the portions 56 and includes a centrally located, circular portion 64 having a pair of opposed, semi-circular notches 66 extending outwardly from the perimeter of the portion 64. As seen in FIG. 2, the plate 62 also has a pair of opposed, flattened, approximately trapezoidal shaped flange portions 68, with each trapezoidal flange 68 presenting a pair of converging terminal edges 70. As best seen in FIGS. 2 and 3, four circular apertures 72 are positioned in the corresponding four corners of hub 50 at the joinder of the plate 62 to the portions 56. Thus, plate 62 spans the distance between U-shaped portions 56, in such a manner that the convergent edges 70 of trapezoidal flanged 68 are adjacent the angled edges 61 of the respective secondary walls 60; in this fashion, elongated spaces 74 are defined between the edges 70, 61.

In manufacturing procedures, the hub 50 and plate 62 are formed from a flattened, rectangularly shaped metal blank. Beginning with this blank, the aperture 72, cutout portion 64, and notches 66 are formed by conventional techniques. Two cuts are then made in the blank from each apertures 72 to adjacent blank margins in order to define a generally V-shaped relieved area and the edges 61, 70. The respective secondary walls 60 and the trapezoidal flanges 68 are then formed by appropriate bending of the blank along the side margins thereof. Finally, the blank is transversely bent to define the upstanding portions 56 and transverse apertured plate 62. In this regard, it will be appreciated that the apertures 72 and elongated spaces 74 provide relief in the blank 76 during the bending operations.

During installation, the anchor member 16 is first telescoped over the elongated rod 14 by passing the shaft 24 through the cutout 64 and sliding the anchor member 16 down the length of shaft 24 until the plate 62 reaches the drive boss 32. The drive boss 32 is thereupon rotated such that the ears 46 are aligned with notches 66 and pass therethrough. The hub is then slid downwardly until the underside of plate 62 contacts the engagement face of flange 30. The anchor member 16 and drive boss 32 are then axially rotated relative to each other such that the ears 46 and notches 66 are misaligned (see FIG. 6), thus interfitting a portion of the plate 62 between the ears 46 and face 40. In this position, a wrench-receiving area 78 is defined by the space between the drive portion 44 of boss 32 and the adjacent sections of the inner walls of hub 50. As shown in FIGS. 6 and 7, the wrench-receiving area 78 is complementally dimensioned for sliding reception of the tubular wrench 12 such that the outer walls of the wrench 12 drivingly engage the inner walls of the hub 50 and the inner walls of the wrench 12 drivingly engage portions of the outer surface of drive boss 32. This mating fit between the wrench 12, boss 32, and hub 50 permits installation of the anchor 10 by axial rotation of the wrench 12, thereby imparting corresponding axial rotation to both rod 14 and anchor member 16. When the anchor 10 has been installed to the desired depth (using extensions of rod and wrench tube, if necessary), the wrench is withdrawn by pulling the same upwardly, and thereby leaving the anchor 10 installed in place with the shaft 24 exposed for a desired anchoring application.

The concepts of the present invention permit a wide variety of variations in specific anchor configurations. For example, a plurality of anchor members 16 can be telescoped over the rod 14 for additional load-bearing capacity. Another important feature of the preferred embodiment is the ability to inexpensively adapt the anchor for use with wrenches having different internal dimensions. (Wrenches having square internal cross-sectional areas of either 1.5" or 1.375" nominal internal widths are in widespread use.) Advantageously, the same lead portion 22 and the same anchor member 16 can be used with either of the most commonly used wrenches, resulting in significant inventory reductions and corresponding cost savings. If it is desirable to use a wrench having smaller than normal internal dimensions, a different lead portion 22 is employed having a drive boss adapted to fit the desired wrench. The same anchor member 16 is used and inasmuch as the lead 22 is threadably secured to the rod, changeover to such a different lead is but a simple matter. In one such modification, a generally square in cross-section drive boss is provided which is dimensioned for reception through the main cutout portion 64 without the need for the clearance provided by notches 66. In this case, the smaller drive boss is configured so that the internal walls of the smaller wrench will drivingly engage the outer surfaces of the boss.

Two additionaly embodiments of the present invention are shown in FIGS. 8–11 and differ from the preferred embodiment in certain details of construction of the anchor member. FIGS. 8–9 illustrate an anchor member 80 presenting a bore-defining, integral U-shaped in cross-section hub 82 formed by a pair of opposed sidewalls 84 and a back wall 85. As in the preferred embodiment, an apertured plate 86 is secured to the hub 82 and contains a centrally located circular portion 88 with a pair of opposed, semicircular shaped notches 90 extending radially from the periphery of portion 88. Advantageously, the helical blade 92 affixed to the hub 92 has a linear edge 94 spanning the open end of the U-shaped hub 82 between the respective sidewalls 84. Thus, the walls 84, 85 of the U-shaped hub 82, in conjunction with the edge 94, cooperatively define a generally square in cross-section, elongated bore 96.

FIGS. 10–11 illustrate a third embodiment in accordance with the present invention. This embodiment is identical in most details with the above-described preferred embodiment, and accordingly, the same reference numerals are employed to denote identical components. The major difference resides in the dimensions of the secondary walls 60, which are of a size that opposed U-shaped portions 56 are no longer spaced apart; rather these portions 56 abut along edges 100 betwen the upstanding marginal edges of the portions 56. Advantageously, the walls 60 are welded along the edges 100, thereby fixedly interconnecting the U-shaped portions 56 and substantially strengthening the torsional capacity of hub 50.

The modular construction of the anchor of the present invention permits separate driving connection between the wrench and both the anchor member and elongated rod component. Such a construction allows the anchor of the present invention to be installed successfully in rocky soils and the like, without structural failure of the anchor. While the anchor of the present invention may be used with many different diameter guy rods, the design is particularly useful for use with small diameter rods. The three embodiments of the present invention discussed above can withstand an amount of torque more than sufficient for many anchoring applications.

What is claimed is:

1. An earth anchor comprising:

an elongated rod having an earth-penetrating lead adjacent one end thereo, an outwardly extending flange adjacent said lead, and a drive boss adjacent said flange, said boss being polygonal in cross-section for a portion thereof;

an anchor member including an elongated, bore-defining hub and an outwardly extending load-bearing element secured to said hub; and an apertured plate secured to said hub and disposed transverse to the longitudinal axis of the hub, said plate aperture being dimensioned and arranged for clearance of said drive boss, said rod extending into said hub bore, with said flange being adjacent one end of said hub and said boss extending through said plate aperture such that portions of said hub bore surround said boss in spaced relationship thereto for cooperatively defining a wrench-receiving area, the configuration of said hub bore portions and said boss being correlated such that said wrench-receiving area is sufficient for passage of a complemental wrench tube between said hub bore portions and said boss, for establishing a driving engagement between said tube, boss, and bore portions, whereby axial rotation distributes rotative driving forces from the tube to the rod and anchor member and effects corresponding rotation to said rod and anchor member in unison, in order to facilitate installation of the anchor into the earth.

2. An earth anchor as set forth in claim 1, said plate aperture being configured to present a centrally located, generally circular portion and a pair of opposed, arcuate notches extending outwardly from the perimeter of said generally circular portion.

3. An earth anchor as set forth in claim 2, said bore-defining hub comprising a pair of opposed, U-shaped in cross-section elements each having an elongated, flattened primary wall with a relatively short, flat transverse secondary wall at each distal edge thereof.

4. An earth anchor as set forth in claim 3, said U-shaped elements being spaced apart.

5. An earth anchor as set forth in claim 2, said bore-defining hub having three interconnected walls cooperatively forming a U-shaped body having an open side, and said load-bearing element comprises a helical screw blade secured to said hub and spanning said open side, said three walls and the part of said blade spanning said open side serving to cooperatively define an approximately square in cross-section bore.

6. An earth anchor as set forth in claim 1, said drive boss including a lower neck portion adjacent said flange and an upper, enlarged drive section, adjacent said neck portion, said drive section having ear segments extending outwardly beyond the outermost, periphery of said neck portion.

7. An earth anchor as set forth in claim 6, said neck portion and drive section being integral and said drive section presenting an approximately rhomboidal shaped cross-section.

* * * * *